US009057238B2

(12) United States Patent
Shaw

(10) Patent No.: US 9,057,238 B2
(45) Date of Patent: Jun. 16, 2015

(54) TREE CAP WEDGE SEAL SYSTEM AND METHOD TO OPERATE THE SAME

(75) Inventor: Michael Shaw, Aberdeenshire (GB)

(73) Assignee: Vetco Gray U.K. Limited, Bridge of Don (GB)

( * ) Notice: Subject to any disclaimer, the term of this patent is extended or adjusted under 35 U.S.C. 154(b) by 436 days.

(21) Appl. No.: 13/475,495

(22) Filed: May 18, 2012

(65) Prior Publication Data

US 2013/0306325 A1 Nov. 21, 2013

(51) Int. Cl.
*E21B 7/12* (2006.01)
*E21B 33/035* (2006.01)

(52) U.S. Cl.
CPC ..... *E21B 33/035* (2013.01)

(58) Field of Classification Search
CPC ..... E21B 33/035; E21B 33/037
USPC ..... 166/338, 351, 360, 368, 75.13, 192; 277/323
See application file for complete search history.

(56) References Cited

U.S. PATENT DOCUMENTS

| | | | | |
|---|---|---|---|---|
| 5,509,476 | A * | 4/1996 | Vick, Jr. | 166/75.13 |
| 5,992,526 | A | 11/1999 | Cunningham et al. | |
| 5,996,697 | A * | 12/1999 | Vick et al. | 166/386 |
| 6,367,551 | B1 | 4/2002 | Fenton | |
| 7,621,338 | B2 | 11/2009 | Wenham et al. | |
| 7,677,319 | B2 | 3/2010 | Baskett | |
| 7,743,832 | B2 | 6/2010 | Shaw et al. | |
| 7,909,103 | B2 | 3/2011 | Fenton | |
| 8,087,465 | B2 * | 1/2012 | Huang et al. | 166/339 |
| 8,230,928 | B2 * | 7/2012 | Cuiper et al. | 166/338 |
| 8,256,538 | B1 * | 9/2012 | Deslierres et al. | 175/235 |
| 8,276,672 | B2 * | 10/2012 | Buckle | 166/368 |
| 2004/0216885 | A1 | 11/2004 | Bartlett | |
| 2007/0007012 | A1 * | 1/2007 | Bartlett et al. | 166/344 |
| 2008/0190621 | A1 | 8/2008 | Huang et al. | |
| 2008/0210435 | A1 | 9/2008 | Goonetilleke et al. | |
| 2008/0230229 | A1 | 9/2008 | Shaw et al. | |
| 2009/0071656 | A1 | 3/2009 | Shaw et al. | |
| 2009/0266551 | A1 | 10/2009 | Cuiper et al. | |
| 2010/0006301 | A1 | 1/2010 | Fenton | |
| 2010/0206575 | A1 * | 8/2010 | Theiss et al. | 166/368 |

(Continued)

OTHER PUBLICATIONS

"Internal tree cap features ROV handling, metal seals," Offshore, www.offshore-mag.com/articles/print/volume-69/issue-12/equipment, 2011, 4 pages.

(Continued)

*Primary Examiner* — Matthew Buck
*Assistant Examiner* — Aaron Lembo
(74) *Attorney, Agent, or Firm* — Bracewell & Guiliani LLP

(57) ABSTRACT

A tree cap has a wedge type annular metal seal for capping and sealing a subsea tree and associated methods to energize the same. The tree cap includes a cam element having a lower end with a conical profile adapted to be disposed within a respective bore of the subsea tree. The cam element moves along an axis of the bore. The annular metal seal is disposed on an outer diameter of the cam element so that the cam element may compress the annular metal seal against an actuation member to seal the bore of the subsea tree. The tree cap includes a housing adapted to be disposed on and secure to the subsea tree. The housing carries the cam element and exerts an axial force on the cam element to deform the annular metal seal into sealing engagement between the tree cap and the subsea tree.

21 Claims, 10 Drawing Sheets

(56) References Cited

U.S. PATENT DOCUMENTS

| | | | | |
|---|---|---|---|---|
| 2012/0273220 | A1* | 11/2012 | Ezekiel et al. | 166/360 |
| 2013/0175054 | A1* | 7/2013 | Hart et al. | 166/387 |

OTHER PUBLICATIONS

GB Search and Examination Report dated Nov. 11, 2013 from corresponding Application No. GB1308594.9.

* cited by examiner

TREE CAP WEDGE SEAL SYSTEM AND METHOD TO OPERATE THE SAME

BACKGROUND OF THE INVENTION

1. Field of the Invention

This invention relates in general to subsea sealing systems and, in particular, to a metal sealing system for subsea trees and tree caps and a method to operate the same.

2. Brief Description of Related Art

The working environment for subsea equipment is increasingly demanding as drilling at deeper subsea locations subjects the subsea equipment to higher temperature extremes, higher working fluid pressures, and chemical attack. Current subsea equipment, such as subsea trees used to complete and produce from a subsea well, typically use elastomeric seals to seal bores of the subsea equipment and to seal between components coupling different interacting subsea equipment together. In situations where the subsea tree is capped, for example with a subsea tree cap, elastomeric seals are generally used to seal the subsea tree cap to a head of the subsea tree to prevent seepage of wellbore fluids into the surrounding subsea environment. Unfortunately, elastomeric seals may not have sufficient durability or resiliency to withstand the temperature and pressure ranges as well as the fluid toxicity found in deeper well installations. Thus, the elastomeric seals may not be sufficiently reliable for use during the required lifespan of the subsea tree cap.

To overcome the limitations of elastomeric seals, some tree caps use metal sealing systems to create the seal between the tree cap and the subsea tree. The metal seal systems may provide a seal that will withstand the temperature, pressure, and fluid toxicity issues encountered in deeper well installations. Metal seals are placed in areas to be sealed and energized to seal opposing surfaces. Typically, energizing a metal seal requires significant sealing stresses at the contact areas between the seal and the opposing surfaces to create a gas and fluid tight seal. This may be true even at lower fluid pressures. To create the sealing stresses at the contact areas, a high degree of interference fit, i.e. sufficient overlap between the width of the seal and the width of the annulus, between the seal and the annulus is required. The high degree of interference fit requires a significant external load to fit the seal, typically applied with the static weight of the part being sealed. However, a subsea tree cap does not have sufficient mass to overcome the high degree of interference fit with static weight alone, this necessitates use of a device having sufficient force generating capability to energize the seal. Alternatively, metal sealing systems may use a secondary mechanical device which generates an internal load to push fit the seal into sealing contact with the annulus. In another alternative system, the tree cap includes a secondary mechanical device that creates sealing stresses after the seal is positioned in the annular space.

The difficulty in latching different equipment together subsea to generate a reaction load makes mechanically aided push fit of an interference fit seal problematic for metal seals. Typically where insufficient static weight is available to set a metal seal, the seal is not interference fit; instead, the seal is energized once positioned in the annular space. In some designs, U-shaped metal seals are typically energized using a hydraulic tool capable of generating large forces that drive an energizing ring between legs of the U-shaped seal, thus driving the legs of the U-shaped seal radially outward into sealing engagement with opposing surfaces. These tools add significant weight to the assembly, require very tight tolerancing on parts and may be complex; Consequently, these tools have an inherent risk of failure that comes with that complexity. U-shaped seals are pressure containing seals that are generally formed of high strength material and require significant sealing stresses to function. In addition, for small tree bores of less than five inches, U-shaped seals are generally unreliable and difficult to make. Therefore, the U-shaped seal systems may be unsuitable for use with subsea trees, specifically those with bores of less than five inches. Still further, the U-shaped seal systems require sealing surfaces on both the seal and the opposing surfaces to be in excellent condition for the seal to function. In particular, the seal and the subsea tree must have a good surface finish having no scratches, no defects, and no inclusions.

Subsea tree caps are often run subsea using remote operated vehicles (ROVs). ROVs are typically limited regarding the weight of the articles the ROV can handle. This weight limit renders many of the energizing mechanisms previously described impractical. Therefore, there is a need for a metal sealing system for sealing a tree cap to a subsea tree that is sufficiently simple yet still generates the appropriate stresses or forces to seal between the subsea tree cap and the subsea tree that may be deployed by an ROV.

SUMMARY OF THE INVENTION

These and other problems are generally solved or circumvented, and technical advantages are generally achieved, by preferred embodiments of the present invention that provide a tree cap wedge seal system and method to operate the same.

In accordance with an embodiment of the present invention, a tree cap assembly for capping a bore of a subsea wellhead assembly, the bore having an axis is disclosed. The tree cap assembly includes an annular cage member selectively insertable into a bore formed in the wellhead assembly, the annular cage having an interior. An annular actuation member depends from a lower end of the cage member. The tree cap assembly also includes a cam element having a portion positioned in the interior of the cage member and axially movable with respect to the cage member. The tree cap assembly further includes an annular seal between the cam element and an inner surface of the bore. The cam element selectively energizes the annular seal by compressing the annular seal axially against the actuation member to form a pressure barrier in the bore. The tree cap assembly includes a locking assembly including a dog that projects radially outward through a sidewall of the cage member into selective engagement with a groove that circumscribes the bore, and an actuation assembly coupled to the cam element so that when actuated, the actuation assembly moves the cam element axially relative to the annular cage to compress the seal against the actuation member.

In accordance with another embodiment of the present invention, a tree cap assembly for capping a bore of a subsea wellhead assembly, the bore having an axis is disclosed. The tree cap assembly includes an annular cage member selectively insertable into a bore formed in the wellhead assembly, the annular cage having an interior and an depending from a lower end of the cage member. The assembly also includes a cam element having a portion positioned in the interior of the cage member and axially movable with respect to the cage member, and an annular seal between the cam element and an inner surface of the bore. The cam element selectively energizes the annular seal by compressing the annular seal axially against the actuation member to form a pressure barrier in the bore. The tree cap assembly also includes a locking assembly comprising a dog that projects radially outward through a sidewall of the cage member into selective engagement with a groove that circumscribes the bore. A housing having a cavity and configured to receive and direct hydraulic pressure is also included in the tree cap assembly. A hydraulic piston having an actuation surface and a retrieval surface is positioned in a cavity of the housing and configured to move axially in response to application of hydraulic fluid pressure to the actuation and retrieval surfaces. The cam element couples to the hydraulic piston so that axial movement of the hydraulic piston moves the cam element to compress the annular seal against the actuation member by moving the cam element axially relative to the annular cage. The tree cap assembly includes one or more valves actuable to selectively permit application of hydraulic fluid pressure to the actuation and retrieval surfaces of the hydraulic piston. The tree cap assembly further includes an accumulator to store at least one of hydraulic fluid pressure and gas pressure, and a charge valve in communication with the accumulator to selectively supply at least one of hydraulic fluid pressure and gas pressure to the accumulator and vent at least one of hydraulic fluid pressure and gas pressure from the accumulator. An accumulator valve is positioned between the accumulator and the actuation assembly and is in communication with the actuation surface of the hydraulic piston to selectively allow communication between the accumulator and the actuation surface of the hydraulic piston. The accumulator, the charge valve, and the accumulator valve are configured to selectively apply at least one of hydraulic fluid pressure and gas pressure to the actuation surface of the hydraulic piston. The application of at least one of hydraulic fluid pressure and gas pressure from the accumulator maintains the energization of the seal.

In accordance with yet another embodiment of the present invention, a method for capping and sealing a subsea tree including a tree head, a bore having an axis, and a locking groove formed therein is disclosed. The method provides a subsea tree cap having a cam element carrying an annular metal seal having a wedge type profile. The cam element is moveable along the axis of the bore. The method runs the subsea tree cap to the subsea tree located proximate to the sea floor and positions the cam element in the bore and lowers the subsea tree cap to land on the subsea tree. The method moves the cam element axially upward to secure the tree cap to the subsea tree and deformingly engage the annular metal seal to seal to the tree cap and the bore of the subsea tree.

An advantage of a preferred embodiment is that it provides a subsea tree wedge seal system that can be fitted and retrieved by an ROV. The disclosed embodiments are simple to use and have a robust and reliable design. In addition, the disclosed embodiments use a metal sealing system that can function in an extreme temperature, pressure, and chemical environment. Still further, the disclosed embodiments may seal to surfaces having defects or inclusions that may prevent formation of an effective seal by other all metal sealing systems. Moreover, the disclosed embodiments are easily adaptable to any suitable tree bore diameter.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout.

In the following discussion, numerous specific details are set forth to provide a thorough understanding of the present invention. However, it will be obvious to those skilled in the art that the present invention may be practiced without such specific details. Additionally, for the most part, details concerning rig operation, subsea assembly connections, subsea tree operation, and the like have been omitted inasmuch as such details are not considered necessary to obtain a complete understanding of the present invention, and are considered to be within the skills of persons skilled in the relevant art. As used herein, terms such as above and below are used to describe relative position of components of the invention as illustrated and are not intended to limit the disclosed embodiments to a vertical or horizontal orientation.

Figure 1:
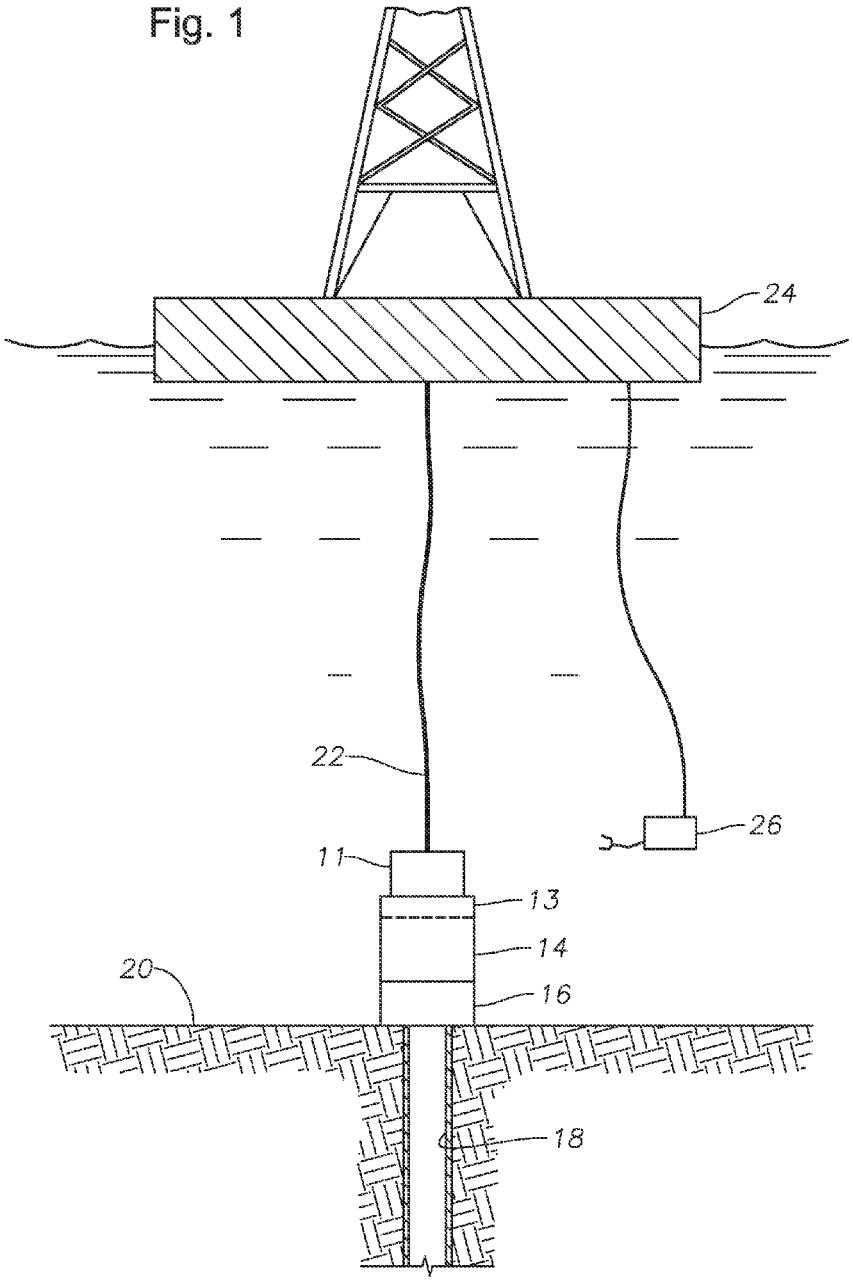
FIG. 1 is a schematic view of a tree cap landed on a subsea tree disposed on a subsea wellhead or a seal floor in accordance with an embodiment.

In the example illustrated in FIG. 1, a tree cap 11 may be disposed on a tree head 13 of a subsea tree 14. The subsea tree 14 may, in turn, be disposed on a subsea wellhead 16 located on a lined and cased wellbore 18 extending subsurface from a sea floor 20. A wireline or power umbilical 22 may extend to a vessel or platform 24 at a sea surface. A remotely operated vehicle (ROV) 26 may be disposed proximate to subsea tree 14 to assist in landing and setting tree cap 11. Both tree cap 11 and ROV 26 may receive power, hydraulic or electric, from platform 24 and be operable from the same. In the illustrated embodiment, subsea tree 14 is a vertical subsea tree. A person skilled in the art will understand that other embodiments include horizontal subsea trees. Tree head 13 is an outer portion of subsea tree 14 to which a subsea riser or other device may attach for flow of production fluid from subsea wellhead 16 or for supply of various subsea tools and subsea communication equipment to subsea tree 14 and subsea wellhead 16.

Figure 2:
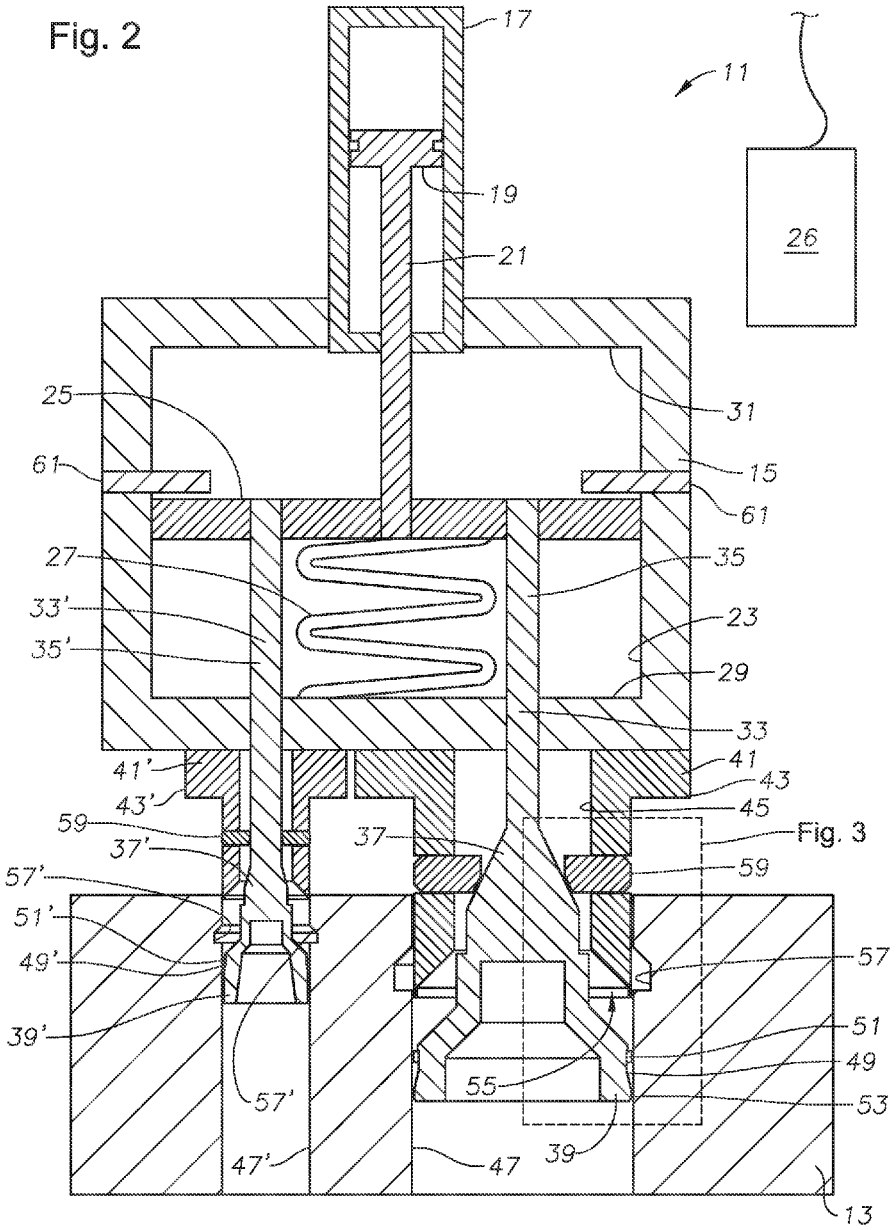
FIG. 2 is a schematic sectional view of the tree cap of FIG. 1 in an un-energized position in accordance with an embodiment.

As shown in FIG. 2, tree cap 11 is disposed above, and partially inserted into tree head 13 of subsea tree 14 (FIG. 1). Tree cap 11 includes a housing 15 having a hydraulic cylinder 17 mounted to an upper portion of housing 15. A person skilled in the art will understand that in alternative embodiments hydraulic cylinder 17 may mount in any suitable location, such as within housing 15. Hydraulic cylinder 17 may be any suitable hydraulically driven piston-type element having a hydraulic cylinder piston 19 and a stem 21. Hydraulic power may be supplied to hydraulic cylinder 17 through power umbilical 22 (FIG. 1). In another embodiment, pressurized hydraulic fluid may be supplied to hydraulic cylinder 17 at the surface and locked into hydraulic cylinder 17. Once tree cap 11 is disposed on three head 13 as described in more detail below, the pressurized hydraulic fluid may be vented, removing the need for power umbilical 22. Hydraulic cylinder piston 19 is disposed in an interior of hydraulic cylinder 17 and has outer peripheries that may seal to the interior walls of hydraulic cylinder 17. Hydraulic fluid pressure may be supplied to oppositely facing surfaces of hydraulic cylinder piston 19 to selectively move hydraulic cylinder piston 19 axially through hydraulic cylinder 17. An end of stem 21 secures to hydraulic cylinder piston 19 so that hydraulic cylinder piston 19 and stem 21 may move as a single body. Stem 21 extends from hydraulic cylinder piston 19 in the interior of hydraulic cylinder 17 into a cavity 23 of housing 15 to meet and mount to a spreader plate 25 positioned in cavity 23. Spreader plate 25 may be a substantially planar member as shown having a width such that outer peripheries of spreader plate 25 may contact interior surfaces of cavity 23. In an embodiment, the outer peripheries of spreader plate 25 may seal to the interior surfaces of cavity 23. An end of stem 21 opposite hydraulic cylinder piston 19 mounts to spreader plate 25 so that spreader plate 25 may move in response to movement of hydraulic cylinder piston 19 and stem 21.

As shown in the example of FIG. 2, a mechanical energizer 27 is positioned in cavity 23 of housing 15 and on a side of plate 25 opposite stem 21. Mechanical energizer 27 extends between an interior surface 29 of cavity 23 proximate to tree head 13 when tree cap 11 is positioned to cap tree head 13 and a facing surface of spreader plate 25. In the illustrated embodiment, mechanical energizer 27 may be a spring positioned so that spreader plate 25 may compress mechanical energizer 27 when spreader plate 25 moves toward interior surface 29 of cavity 23. Mechanical energizer 27 may exert a reactive force on spreader plate 25 urging spreader plate 25 away from surface 29 in response to this compression.

One or more cam elements or capping pistons 33 may mount to spreader plate 25 and extend from spreader plate 25 through housing 15 at interior surface 29. Capping piston 33 includes an elongate stem portion 35, a conical cam portion 37, and a seal carrier portion 39. As shown, stem portion 35 extends from spreader plate 25 through housing 15 to an area below housing 15. Cam portion 37 secures to an end of stem portion 35 opposite spreader plate 25 and has a conical profile having a narrower diameter at stem portion 35 and a wider diameter where cam portion 37 joins seal carrier portion 39 opposite stem portion 35. In the illustrated embodiment, the housing 15 includes a cage member or tubular cage 41 disposed below housing 15. Cage 41 has an end proximate to housing 15 having a flange 43 with a substantially planar surface so that flange 43 may engage an exterior surface of housing 15 opposite interior surface 29. Cage 41 may secure to housing 15 through flange 43 in any suitable manner, such as through fasteners, adhesives, or the like. As shown and described herein, housing 15 and cage 41 may move as a single body. The wider diameter of cam portion 37 is smaller than an inner diameter of cage 41, allowing cam portion 37 to move through cage 41. Cage 41 is a tubular member having an inner bore 45 through which cam portion 37 and stem portion 35 may pass as shown in FIG. 2. An outer diameter of cage 41 may be substantially equivalent to a bore 47 of tree head 13 so that cage 41 may insert into bore 47 as shown.

In the illustrated embodiment, seal carrier portion 39 joins cam portion 37 at the wider portion of cam portion 37 and has a profile that increases in outer diameter from the cam portion 37 to the diameter of bore 47 of tree head 13. Seal carrier portion 39 has an upper cylindrical portion, a medial conical portion, and a lower conical portion having an outer portion at a steeper angle with respect to an axis of bore 47 than an outer surface of the medial conical portion. A person skilled in the art will understand that the profile of seal carrier portion 39 may be conical from cam portion 37 to an end of seal carrier portion 39, may be stepped having no conical portions, or may have any other suitable profile provided tree cap 11 may operate as described herein. Seal carrier portion 39 carries an annular seal 49 and an energizing ring 51 on an outer diameter 53 of the lower conical portion of seal carrier portion 39. An end 55 of cage 41 opposite flange 43 includes a profile adapted to energize seal 49 as described in more detail with respect to FIG. 3.

Continuing to refer to FIG. 2, tree head 13 includes a locking groove 57 axially circumscribing bore 47 into which a locking dog assembly 59 may extend when actuated by cam portion 37 as described in more detail below. Cage 41 can carry locking dog assembly 59 so that cam portion 37 may actuate locking dog assembly 59 during energization of seal 49. In the illustrated embodiment, camp portion 37 actuates locking dog assembly 59 prior to energization of seal 49. Tree cap 11 also includes a mechanical lock assembly 61 mounted in housing 15. Mechanical lock assembly 61 may actuate to limit movement of spreader plate 25 during transportation of tree cap 11, allowing tree cap 11 to be fully assembled prior to shipping, but avoiding the need for internal pressurization of tree cap 11 during transportation and storage. Mechanical locks 61 will be unlatched at the surface prior to running tree cap 11 to the location shown in FIG. 2. Mechanical locks 61 may be any suitable mechanism that prevents movement of spreader plate 25 during transportation and storage of tree cap 11. In the illustrated embodiment mechanical locks 61 may be pins positioned to block movement of spreader plate 25.

As shown in FIG. 2, tree cap 11 may include additional capping pistons 33 and cages 41. In an embodiment, tree cap 11 will include a capping piston 33 and cage 41 for each bore 47 of tree head 13 to be capped by tree cap 11, each mounted to spreader plate 25. In the illustrated embodiment, tree cap 11 may cap two bores 47, 47' of tree head 13 and includes a capping piston 33' and cage 41' sized to fit a smaller bore 47' of tree head 13. Capping piston 33' and cage 41' will include the components of an operate as capping piston 33 and cage 41 described herein. Tree cap 11 of FIG. 2 may generally be considered to be in the unset or unenergized position. Tree cap 11 may be lowered onto tree head 13 from the position of FIG. 2 so that a downward facing shoulder of flange 43 opposite housing 15 contacts a top of tree head 13, preventing further downward movement of tree cap 11.

Figure 3:
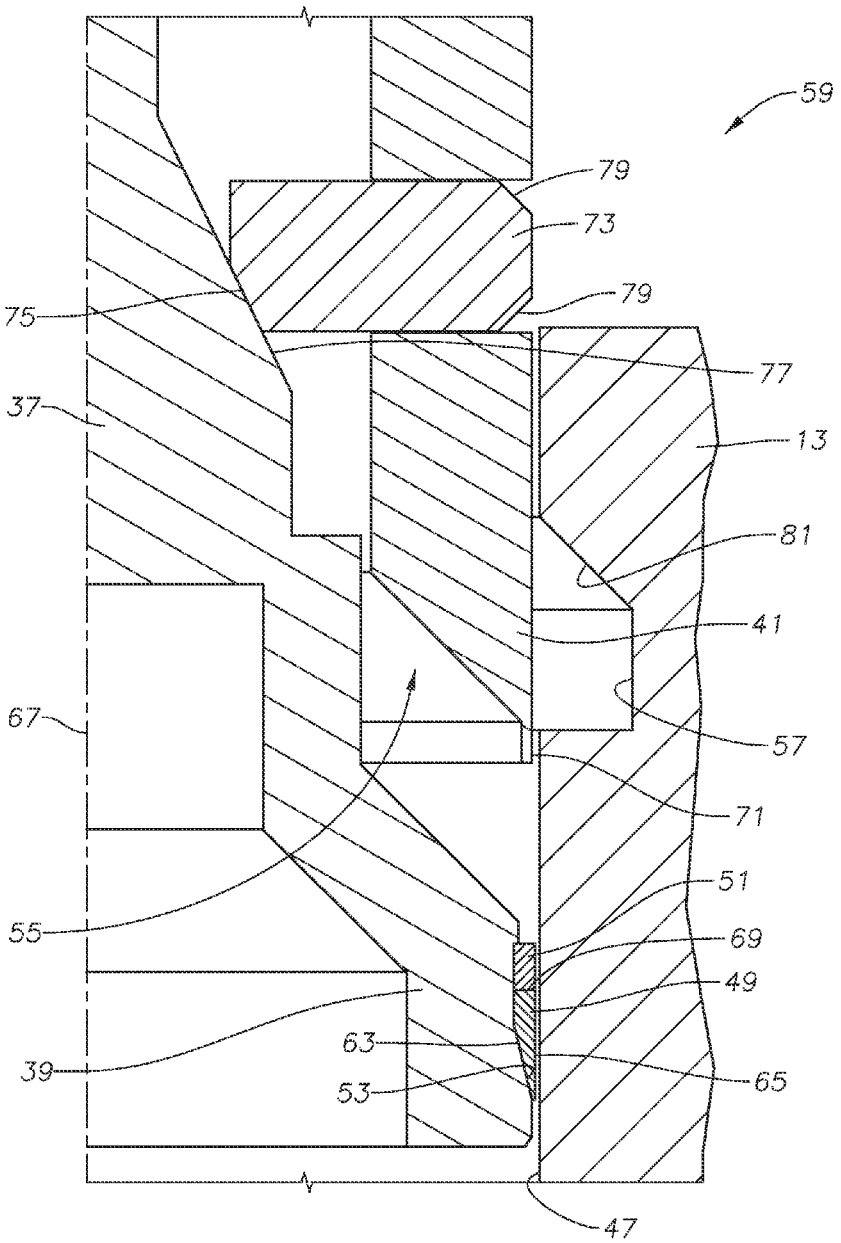
FIG. 3 is a schematic sectional view of a portion of the tree cap of FIG. 2 in the un-energized position in accordance with an embodiment.

Referring to FIG. 3, outer diameter 53 of seal carrier portion 39 has a conical profile having a wider portion at a lower end of seal carrier portion 39 and a narrower end extending upward therefrom. Annular seal 49 has a wedge-type cross sectional profile and is positioned around the conical profile of seal carrier portion 39. An inner surface 63 of annular seal 49 has an angle matching the angle of the conical profile of seal carrier portion 39. A person skilled in the art will understand that in alternative embodiments inner surface 63 may be formed at a different angle than the angle of the conical profile of the seal carrier portion 39. An outer surface 65 of annular seal 49 may be substantially parallel to an axis 67 of bore 47. In an exemplary embodiment, the angle formed between outer surface 65 and inner surface 63 is less than 20 degrees and preferably between 3 and 10 degrees. A person skilled in the art will recognize that the angle between inner surface 63 and outer surface 65 may be other suitable angles. Annular seal 49 may have a radial surface 69 extending between inner surface 63 and outer surface 65. In the illustrated embodiment, radial surface 69 is substantially perpendicular to outer surface 65 and axis 67. In the illustrated embodiment, annular seal 49 may be formed of a compliant metal. For example, annular seal 49 may be formed of lead, tin, silver, gold, alloys thereof, or the like. A person skilled in the art will understand that the listing of metals used herein is not intended to be exclusive and that other metals having compliant characteristics may be used to form annular seal 49. Annular seal 49 may be manufactured in any suitable manner. In an embodiment, annular seal 49 may be formed from a preformed solid ring that is cast or compression molded into the appropriate shape. The ring may then be annealed and in some embodiments finished machined to improve the surface finish and geometry. Alternatively, annular seal 49 may be formed from solid wire positioned on outer diameter 53 of seal carrier portion 39 and having the end joints soldered, brazed, or welded to form a continuous ring. In these embodiments, the ring will be formed fully annealed and having a cross section close to that illustrated herein. The ring may then be cold formed direction onto seal carrier portion 39 using molding tools to do any additional shaping. In still another embodiment, annular seal 49 may be formed through a low-bond strength spray process that coats outer surface 53 of seal carrier portion 39 that allows annular seal 49 to deform as described herein. In these processes, annular seal 49 may not be bonded to seal carrier portion 39.

Energizing ring 51 has a substantially rectangular cross sectional profile and is positioned to engage radial surface 69 of annular seal 49. End 55 of cage 41 has an actuation member 71 extending downward from end 55 along an outer diameter of cage 41. Actuation member 71 has a substantially planar surface that engages energizing ring 51 opposite annular seal 49 during energization of annular seal 49 described in more detail below. In the illustrated embodiment, actuation member 71 has a length extending parallel to axis 67 so that when annular seal 49 is energized, end 55 of cage 41 may be spaced apart from surfaces of seal carrier portion 39. In this manner, the compressing energization force on annular seal 49 and energizing ring 51 may be maintained as the systems adjust to thermal and pressure conditions at the installation site.

Cage 41 also carries locking dog assembly 59. Each locking dog assembly 59 includes a dog 73 extending through a wall of cage 41. In an embodiment, dog 73 is an annular member having a split portion allowing for radial expansion and contraction of dog 73. A person skilled in the art will understand that dog 73 may be one or more members adapted to operate as described herein. As shown, dog 73 has an interior conical cam surface 75 adapted to slidingly engage a conical cam surface 77 of cam portion 37. A person skilled in the art will recognize that conical cam surface 75 may be a portion of dog 73 as shown, or alternatively, conical cam surface 75 may extend across the entire interior portion of dog 73. In the illustrated embodiment, the angle of mating cam surfaces 75, 77 is between 5 and 15 degrees with respect to axis 67. In an exemplary embodiment, the angle of mating cam surfaces is 10 degrees with respect to axis 67. Dog 73 may be supported by cage 41 so that dog 73 may move radially into locking groove 57 as described in more detail below. An outer periphery of dog 73 may include bevels 79 as shown. In some embodiments, such as those illustrated in FIG. 3, locking groove 57 includes a conical upper surface 81.

Figures 4, 5:
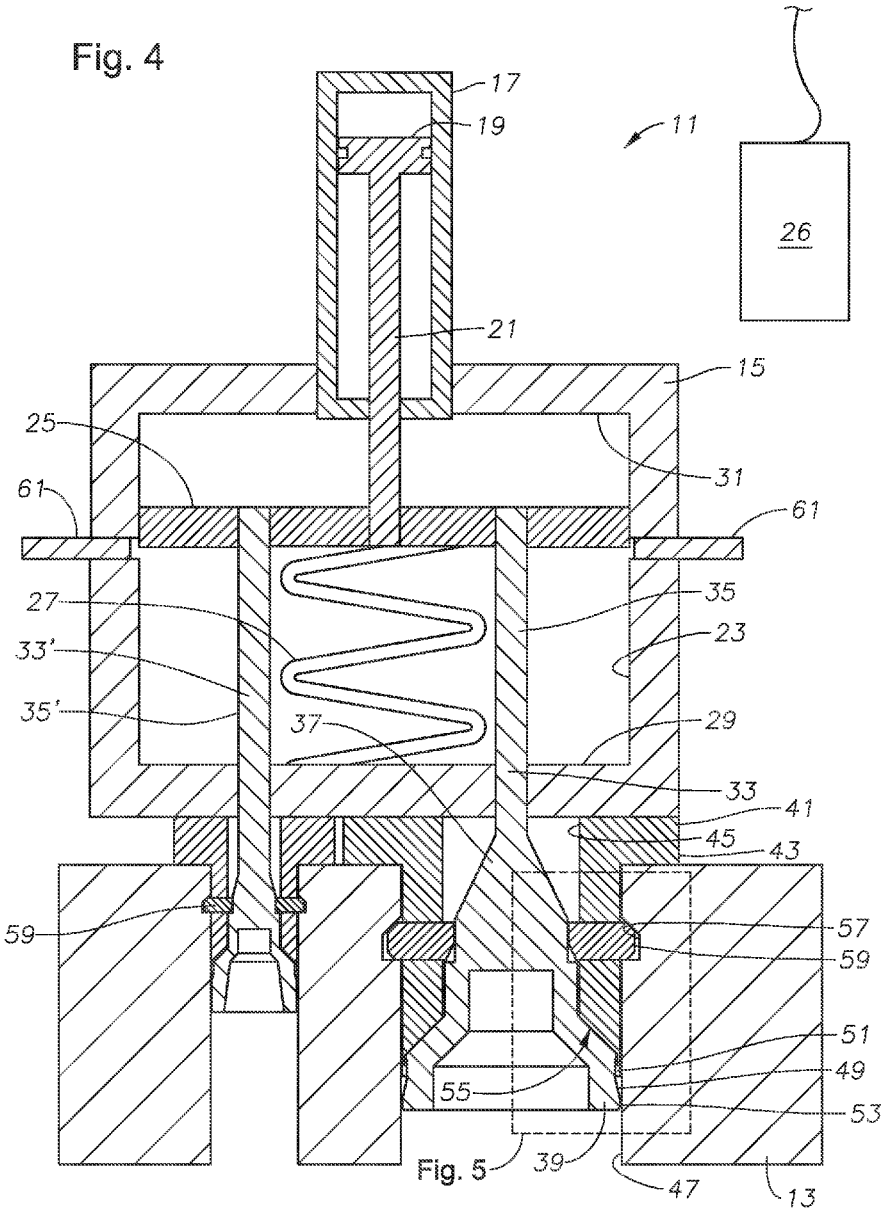
FIG. 4 is a schematic sectional view of the tree cap of FIG. 1 in an energized position in accordance with an embodiment.
FIG. 5 is a schematic sectional view of a portion of the tree cap of FIG. 4 in the energized position in accordance with an embodiment.
Figure 5:
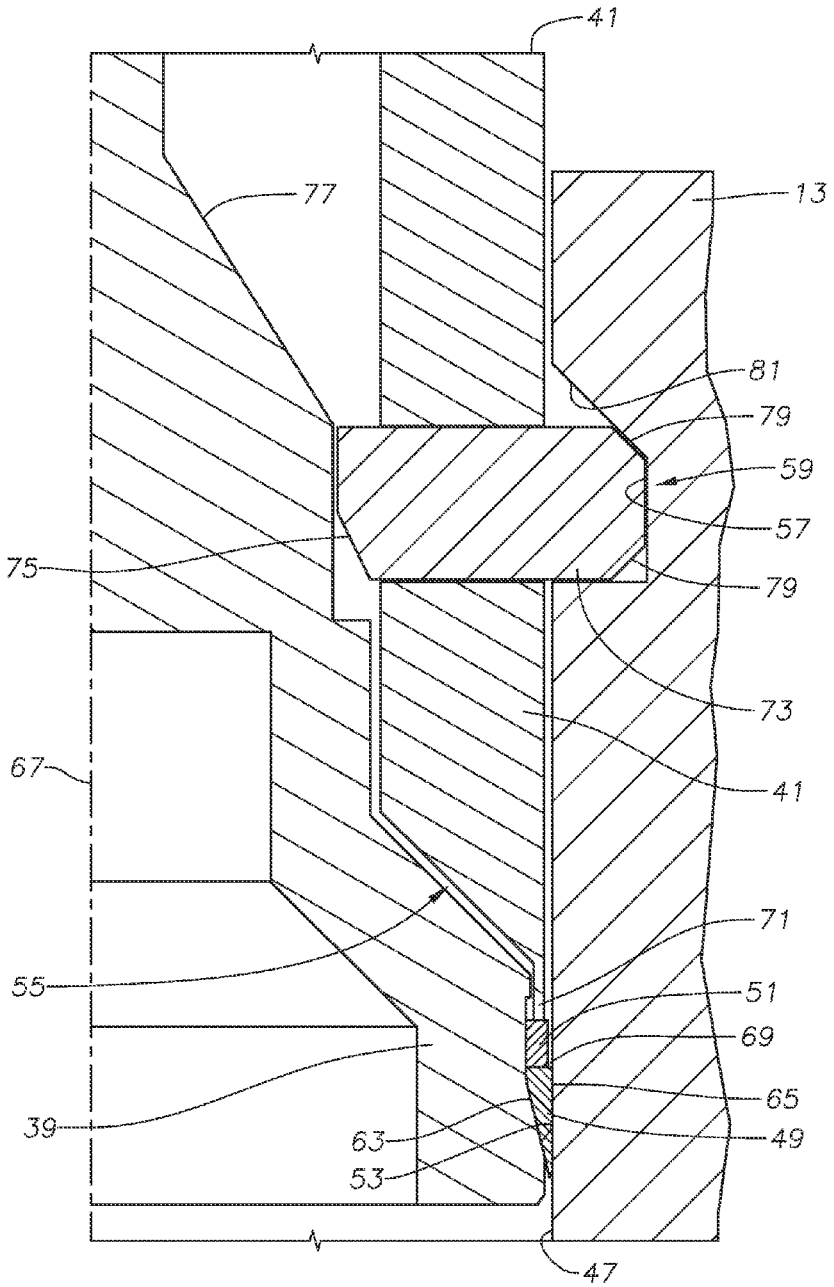

In operation, tree cap 11 may be run through open ocean on a wireline or power umbilical 22 and brought proximate to tree head 13 by ROV 26 shown schematically in FIG. 2. ROV 26 may position tree cap 11 so that seal carrier portion 39, cam portion 37 and end 55 of cage 41 are positioned with a respective bore 47 of tree head 13. Tree cap 11 may be further lowered until a downward facing shoulder of flange 43 contacts an upward facing surface of tree head 13, thereby limiting further downward movement of tree cap 11. In this position, cage 41 below flange 43, locking dog assembly 59, cam portion 37 and seal carrier portion 39 of capping piston 33, and seal 49 are positioned in bore 47 of tree head 13. As shown in FIG. 4, dog 73 may be radially adjacent to locking groove 57 when flange 43 of cage 41 lands on tree head 13. During the running operation, hydraulic fluid is supplied or locked in to hydraulic cylinder 17 to maintain a downward force on spreader plate 25 that compresses mechanical energizer 27.

As shown in FIG. 4, hydraulic fluid pressure may be removed from hydraulic cylinder 17, the mechanical energy of mechanical energizer 27 can overcome downward tending force on spreader plate 25. In response, spreader plate 25 may move toward surface 31 of cavity 23, pulling the mounted capping piston 33 toward surface 31 of cavity 23. As capping piston 33 moves toward surface 31, cam portion 37 actuates locking dog assembly 59 until a portion of dogs 73 are positioned within locking groove 57, the capping piston 33 continues to move until it forces the energizing ring 51 into engagement with end 55 of cage 41 to energize annular seal 49 as described below with respect to FIG. 5.

Movement of capping piston 33 toward surface 31 of cavity 23 causes cam surface 77 of cam portion 37 to slidingly engage cam surface 75 of dog 73, driving dog 73 radially outward into locking groove 57 as cam surface 75 slides against the larger diameter portion of cam surface 77 of cam portion 37. In this manner, tree cap 11 secures to tree head 13 to maintain tree cap 11 on tree head 13. In addition, actuation member 71 engages a surface of energizing ring 51 opposite annular seal 49 and applies a downward force on energizing ring 51. The downward force on energizing ring 51 drives energizing ring 51 into annular seal 49. The downward force on energizing ring 51 causes energizing ring 51 to compress annular seal 49 against the conical profile of outer diameter 53 of seal carrier portion 39. This forces inner surface 63 of annular seal 49 to slide relative to the conical profile of outer diameter surface 53 on cam portion 37, causing radial displacement of annular seal 49. The radial displacement of annular seal 49 forces annular seal 49 into sealing engagement with bore 47 of tree head 13. In an exemplary embodiment, annular seal 49 may be formed of a compliant metal as described above so that energizing ring 51 causes annular seal 49 to deform into sealing engagement with bore 47 of tree head 13. Actuation member 71 may energize annular seal 49 while maintaining separation between cage 41 and capping piston 33. In this manner, the upward force exerted by mechanical energizer 27 may accommodate variation in the sealing area between seal 49 and bore 47 of tree head 13 caused by thermal expansion and contraction, and creep and stress relaxation of the material from which annular seal 49 is formed. The separation between cage 41 and capping piston 33 allows movement of capping piston 33 relative to cage 41 that permits this accommodation. A person skilled in the art will understand that fluid pressure in bore 47 may exert an upward force on seal carrier portion 39 and cam portion 37 to cause further sealing engagement of annular seal 49 into bore 47 of tree head 13. Interaction between dog 73 and medial portion 37 of capping piston 33 prevents inadvertent removal of tree cap 11 from bore 47. As the upward force of fluid pressure in bore 47 tends to push both capping piston 33 and cage 41 out of bore 47, conical surface 81 of locking groove 57 will tend to drive dog 73 radially inward through sliding engagement between conical surface 81 and bevel 79. The radially inward movement pushes dog 73 against the vertical exterior surface of medial portion 37 of capping piston 33, preventing removal of dog 73 from locking groove 57.

Figure 6:
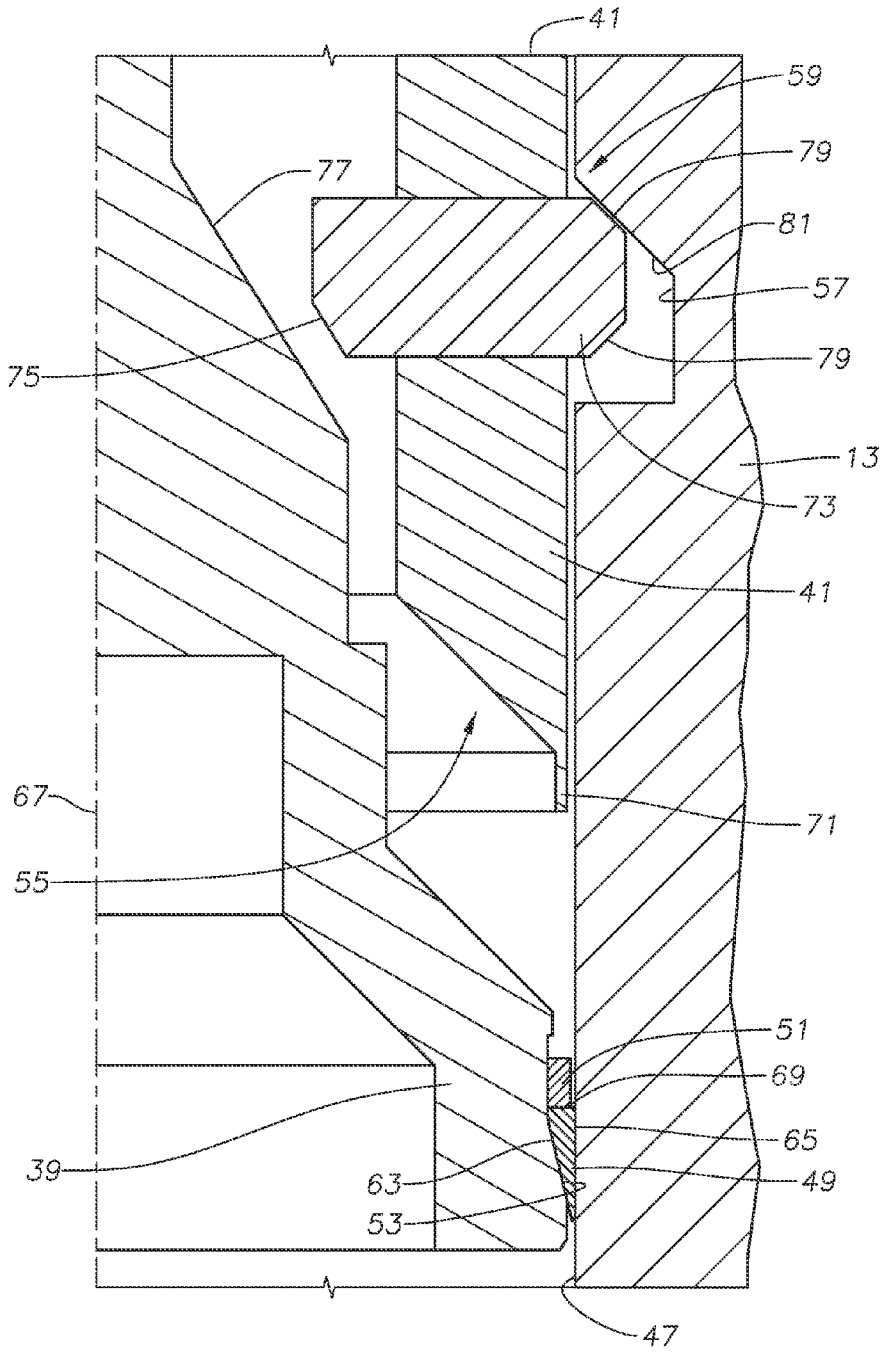
FIG. 6 is a schematic sectional view of the portion of the tree cap of FIG. 1 during retrieval of the tree cap in accordance with an embodiment.

As shown in FIG. 6, tree cap 11 may be pulled from tree head 13. Hydraulic fluid pressure may be supplied to hydraulic cylinder 17 through power umbilical 22 so that hydraulic cylinder piston 19 moves axially downward. This drives spreader plate 25 toward surface 29 and compresses mechanical energizer 27 as shown in FIG. 2. In addition, this releases the sealing forces on annular metal seal 49 and the radial forces on dog 73 as shown in FIG. 6. An upward pull on housing 15 causes bevel 79 to slidingly engage conical upper surface 81. As a force produced by bevel 79 slidingly engages conical upper surface 81 drives dog 73 radially out of locking groove 57, permitting retrieval of tree cap 11 from tree head 13.

A person skilled in the art will understand that the disclosed embodiments include sufficient apparatus and assemblies to permit running, actuation, and retrieval of tree cap 11 by ROV 26. In these embodiments, hydraulic fluid pressure may be supplied by ROV 26 and power umbilical 22 may not extend with tree cap 11 to subsea tree 14.

Figure 7:
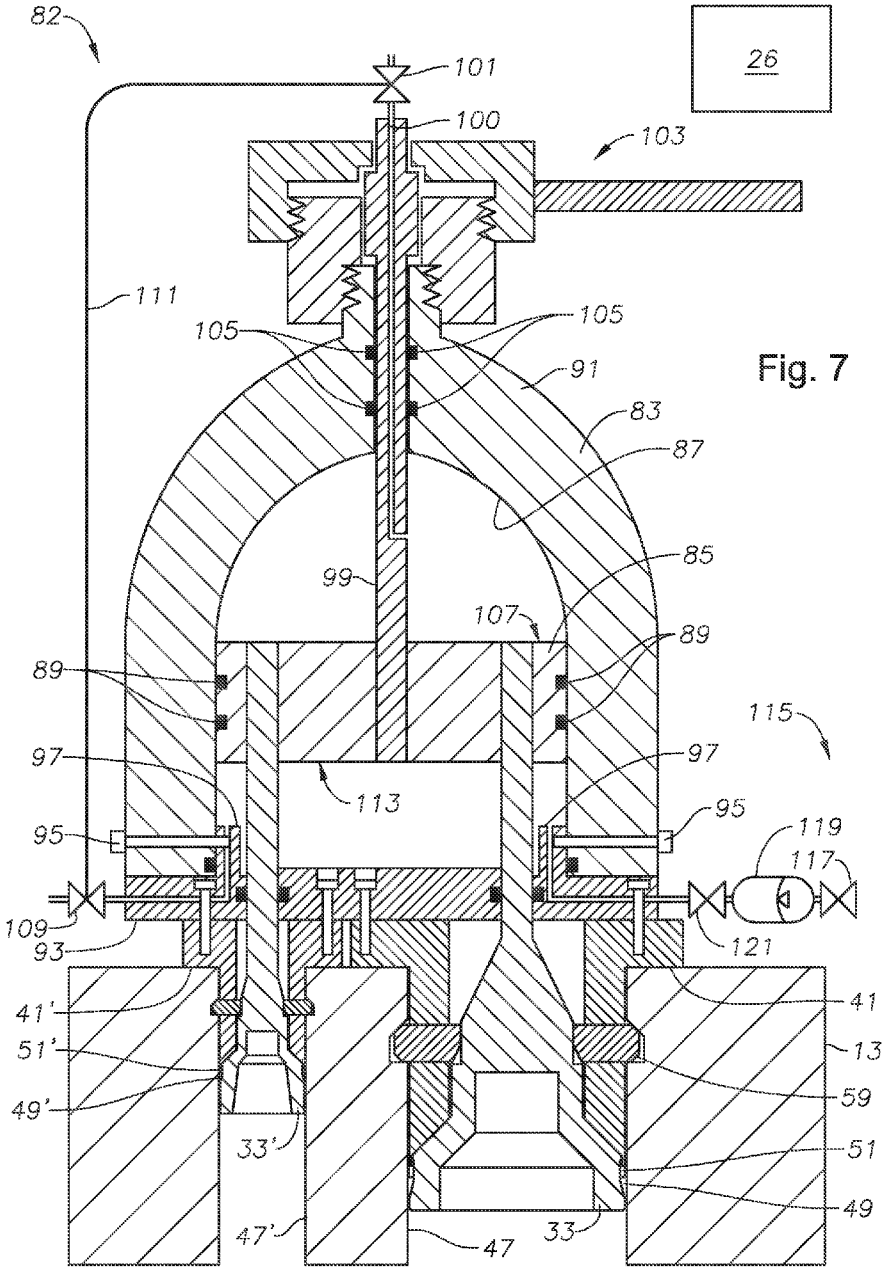
FIG. 7 is a schematic sectional view of an alternate tree cap in an energized position in accordance with an embodiment.

FIG. 7 illustrates a hydraulically actuated alternative tree cap 82. Tree cap 82 may be disposed on tree head 13 of subsea tree 14 in a manner similar to that of tree cap 11 of FIGS. 1-6. Tree cap 82 includes a housing 83 adapted to contain hydraulic fluid pressure in an interior cavity 87 and direct hydraulic fluid pressure onto an actuation piston 85. Housing 83 may be a domed body as illustrated, a cuboid body similar to tree cap 11, or any other suitable shape such that housing 83 contains and directs hydraulic fluid pressure as described herein. In the illustrated embodiment, housing 83 has an open lower end opposite a domed portion 91. Actuation piston 85 seals to cavity 87 with seals 89 so that hydraulic fluid pressure may not pass around actuation piston 85. A pressure cap 93 is coupled to a lower end of housing 83 opposite domed portion 91. In the illustrated embodiment pressure cap 93 couples to housing 83 with fasteners 95 that pass through a wall of housing 83 and secure within bores formed in an annular flange 97 of pressure cap 93.

A stem 99 mounts to actuation piston 85 and extends through domed portion 91. Stem 99 has a fluid passage 100 formed therein for passage of hydraulic fluid from a three-way retrieval valve 101. Stem 99 passes through a manual retrieval apparatus 103 that mounts to an exterior surface of domed portion 91 so that ROV 26 may place and retrieve tree cap 82. Stem 99 seals to housing 83 with seals 105 as stem 99 passes through domed portion 91. Fluid passage 100 extends from three way retrieval valve 101 into a portion of cavity 87 between a retrieval surface 107 of actuation piston 85 and domed portion 91 of housing 83. Hydraulic fluid may selectively pass through three-way valve 101, passage 100, and into cavity 87 to exert a hydraulic force on retrieval surface 107 to move actuation piston 85 to dis-engage from tree head 13 as described in more detail below. Three way retrieval valve 101 may also allow fluid to vent from cavity 87 through passage 100.

Three way retrieval valve 101 may be in fluid communication with a three way actuation valve 109 through a fluid passage 111. In an embodiment, fluid may flow through fluid passage 111 to three way retrieval valve 101 and then into cavity 87. Similarly, hydraulic fluid may flow from cavity 87 through passage 100, three way retrieval valve 101 and into fluid passage 111. Three way actuation valve 109 is in fluid communication with fluid passage 111 and cavity 87 between an actuation surface 113 of actuation piston 85 and pressure cap 93. Hydraulic fluid pressure may be supplied through three way actuation valve 109 to act on actuation surface 113 to move actuation piston 85 toward domed portion 91 of housing 83.

Tree cap 82 also includes an accumulator assembly 115. Accumulator assembly 115 includes a charge valve 117, an accumulator 119, and an accumulator valve 121. Accumulator 119 may be a pressure vessel suitable for storage of hydraulic fluid or gas pressure. Accumulator 119 may have a volume of sufficient size to store the needed hydraulic fluid or gas pressure to maintain annular seal 49 in an energized condition as described in more detail below. Accumulator valve 121 may be in fluid communication with the stored hydraulic fluid or gas pressure in accumulator 119 and further in fluid communication with cavity 87 between actuation surface 113 and pressure cap 93. Accumulator valve 121 may be selectively opened to permit the stored hydraulic fluid pressure or gas pressure in accumulator 119 passage to cavity 87. Charge valve 117 is in fluid communication with accumulator 119 and, in the illustrated embodiment, is the receptacle through which hydraulic fluid or gas pressure may be supplied for storage in accumulator 119.

Tree cap 82 may also include capping pistons 33, 33', cages 41, 41', annular seals 49, 49' energizing rings 51, 51' and locking dog assembly 59, 59' of FIGS. 2-6. These members may generally operate as described above with respect to FIGS. 2-6.

In operation, the area of cavity 87 between actuation surface 113 and pressure cap 93 of tree cap 82 may be filled with hydraulic fluid through three way actuation valve 109 while tree cap 82 is located at platform 24. Three way actuation valve 109 may then be closed to prevent fluid communication through three way actuation valve 109. Accumulator valve 121 may be closed and a pre-charge may be applied to accumulator 119 through charge valve 117. In an embodiment, the pre-charge comprises nitrogen gas pressure supplied to a predetermined pressure that is determined in part based on the total depth at which tree cap 82 may be deployed. Tree cap 82 may then be carried to subsea tree 14 by ROV 26 and landed on tree head 13 as shown in FIG. 1. There, ROV 26 may couple to three way actuation valve 109, open three way actuation valve 109 so that fluid pressure may be supplied to cavity 87 between pressure cap 93 and actuation surface 113 of piston 85. Hydraulic fluid pressure may be supplied to move piston 85 toward domed portion 91 of housing 83, pulling upward on capping pistons 33, 33' to energize seals 49, 49' and actuate locking dog assemblies 59, 59' as described above and illustrated in FIG. 7. Three way actuation valve 109 may then be closed and accumulator valve 121 opened to release the stored gas pressure in accumulator 119 for communication with cavity 87. The nitrogen gas pressure stored in accumulator 119 acts as a pneumatic spring to maintain a force on actuation surface 113 that will maintain seal 49, 49' energized for the lifetime of the operative use of tree cap 82, functioning much as mechanical energizer 27 of FIG. 2-6. In this manner, tree cap 82 may be a lighter apparatus than tree cap 11, making tree cap 82 easier to deploy via ROV 26.

To retrieve tree cap 82, three way actuation valve 109 and three way retrieval valve 101 are actuated to allow flow of hydraulic fluid from the area of cavity 87 proximate to actuation surface 113 to the area of cavity 87 proximate to retrieval surface 107 of actuation piston 85. As fluid pressure equalizes across piston 85, the force on piston 85 decreases then reverses direction due to the pressurized area on actuation surface 113 being smaller than the pressurized area on retrieval surface 107. This means the load energizing seals 49, 49' will be reduced, allowing capping pistons 33, 33' to de-energize and de-actuate seals 49, 49' and locking dog assemblies 59, 59', respectively. In addition, fluid pressure may be supplied to three way retrieval valve 101 by ROV 26 to exert additional force on retrieval surface 107 of actuation piston 85 while venting the nitrogen charge in accumulator 119 to move piston 85 fully to a retrieval position that releases locking dog assemblies 59, 59'. In another embodiment, three way retrieval valve 101 may be opened to the surrounding environment, allowing the ambient pressure at the subsea location to exert additional force on retrieval surface 107 of actuation piston 85, again while venting the nitrogen charge in accumulator 119, to move piston 85 fully to a retrieval position. Still further, if application of hydraulic pressure is insufficient, ROV 26 may physically move actuation piston 85 to the appropriate position by applying a force to stem 99 to, in turn, move actuation piston 85 to the retrieval position. ROV 26 may then carry tree cap 82 to the surface and subsequent operations at wellbore 18 may be performed through subsea tree 14.

Figure 8:
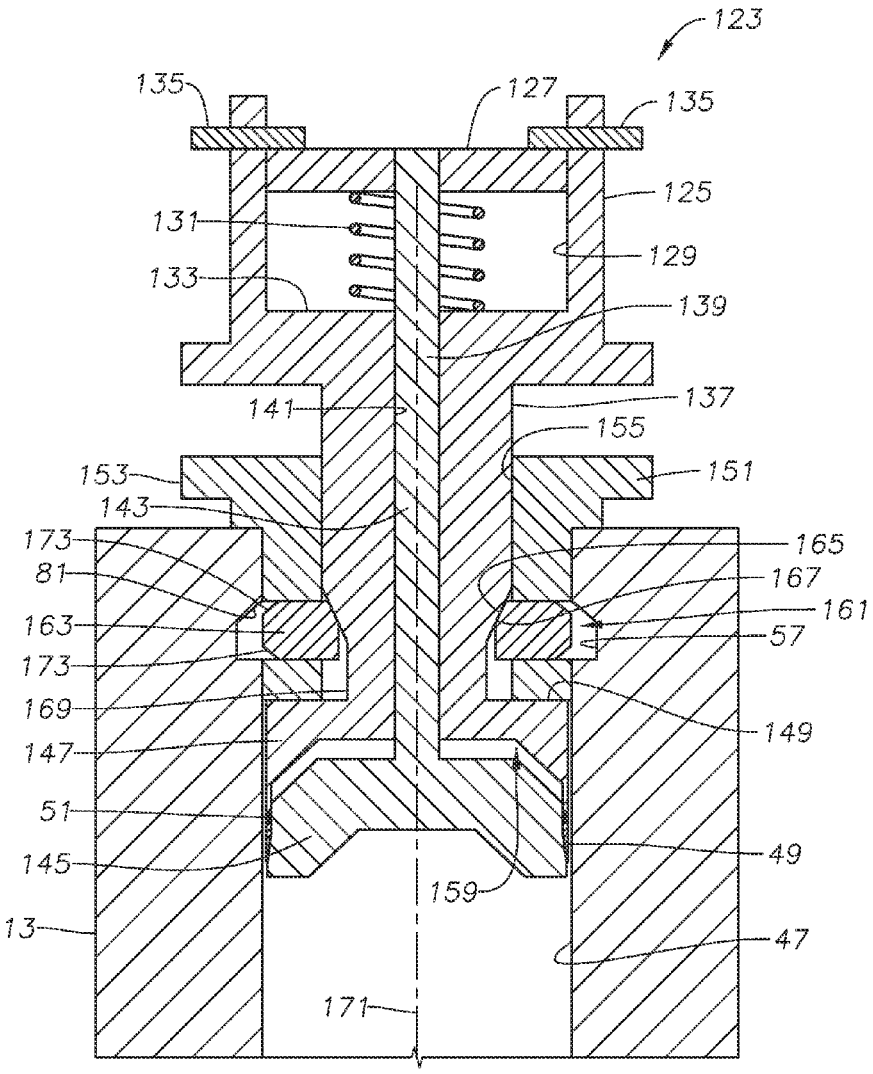
FIG. 8 is a schematic sectional view of an alternate tree cap in an un-energized position in accordance with an embodiment.

As shown an alternative embodiment in FIG. 8, a tree cap 123 is disposed above, and partially inserted into tree head 13 of subsea tree 14 (FIG. 1). Tree cap 123 includes a housing 125 having a spreader plate 127 disposed therein. Spreader plate 127 may be a substantially planar member as shown having a width such that outer peripheries of spreader plate 127 may contact interior surfaces of a cavity 129 formed by housing 125. In an embodiment, the outer peripheries of spreader plate 127 may seal to the interior surfaces of cavity 129.

As shown in the example of FIG. 8, a mechanical energizer 131 is positioned in cavity 129 of housing 125 and on a side of spreader plate 127. Mechanical energizer 131 extends between an interior surface 133 of cavity 129 proximate to tree head 13 when tree cap 123 is positioned to cap tree head 13 and a facing surface of spreader plate 127. In the illustrated embodiment, mechanical energizer 131 may be a spring positioned so that spreader plate 127 may compress mechanical energizer 131 when spreader plate 127 moves toward interior surface 133 of cavity 129. Mechanical energizer 131 may exert a reactive force on spreader plate 127 urging spreader plate 127 away from interior surface 133 in response to this compression. In the illustrated embodiment, mechanical locks 135 are positioned to maintain compression of mechanical energizer 131. Mechanical locks 135 may be disengaged from spreader plate 127 to permit mechanical energizer 131 to move spreader plate 127 away from interior surface 133. A person skilled in the art will recognize that mechanical locks 135 may be any suitable device that may inhibit or prevent undesired movement of spreader plate 127 away from interior surface 133. In addition, a person skilled in the art will recognize that mechanical locks 135 may be operable by an ROV.

Housing 125 includes an actuation portion 137 extending away from housing 125 opposite interior surface 133. In the illustrated embodiment, actuation portion 137 extends into bore 47 of tree head 13. Actuation portion 137 may have an outer diameter less than the diameter of housing 125.

One or more cam elements or capping pistons 139 may mount to spreader plate 127 and extend from spreader plate 127 through housing 125 at interior surface 133. Capping piston 139 may pass through an actuation portion cavity 141 formed at a medial portion of actuation portion 137. Capping piston 139 includes an elongate stem portion 143 and a seal carrier portion 145. As shown, stem portion 143 extends from spreader plate 127 through housing 125 and actuation portion 137 to an area below housing 125. In the illustrated embodiment, actuation portion 137 includes a lower portion 147 having a larger diameter than a main body of actuation portion 137. Lower portion 147 defines an upward facing shoulder 149. As shown, lower portion 147 has an outer diameter such that lower portion 147 may substantially fill the diameter of bore 47. Tree cap 123 includes a cage member or tubular cage 151 disposed on upward facing shoulder 149. Cage 151 has an end proximate to housing 125 having a flange 153 with a substantially planar surface so that flange 153 may engage an exterior surface of housing 125 opposite interior surface 133. Cage 151 is a tubular member having an inner bore 155 through which actuation portion 137 and stem portion 143 may pass as shown in FIG. 8. An outer diameter of cage 151 may be substantially equivalent to the diameter of bore 47 of tree head 13 so that cage 151 may insert into bore 47 as shown.

In the illustrated embodiment, seal carrier portion 145 joins stem 143 at an end of stem 143 opposite spreader plate 127 and has a profile that increases in outer diameter from stem 143 to the diameter of bore 47 of tree head 13. Seal carrier portion 145 has an upper conical portion and a lower conical portion having an outer portion at a steeper angle with respect to an axis of bore 47 than an outer surface of the upper conical portion. A person skilled in the art will understand that the profile of seal carrier portion 145 may be conical from stem 143 to an end of seal carrier portion 145, may be stepped having no conical portions, or may have any other suitable profile provided tree cap 123 may operate as described herein. Seal carrier portion 145 carries annular seal 49 and energizing ring 51 on an outer diameter surface 157 of the lower conical portion of seal carrier portion 145. A person skilled in the art will recognize that seal carrier portion 145 may be substantially similar to seal carrier portion 39 of FIGS. 1-6 so that annular seal 49 and energizing ring 51 may function and energize as described above with respect to FIGS. 1-6. An end 159 of lower portion 147 of actuation portion 137 includes actuation member 71 of FIG. 3 adapted to energize seal 49 as described in above with respect to FIGS. 1-6.

Continuing to refer to FIG. 8, tree head 13 includes locking groove 57 as described above. A locking dog assembly 161 may extend when actuated by actuation portion 137 as described in more detail below. Cage 151 can carry locking dog assembly 161 so that actuation portion 137 may actuate locking dog assembly 161 during energization of seal 49. In the illustrated embodiment, actuation portion 137 actuates locking dog assembly 161 prior to energization of seal 49.

Cage 151 also carries locking dog assembly 161. Each locking dog assembly 161 includes a dog 163 extending through a wall of cage 151. In an embodiment, dog 163 is an annular member having a split portion allowing for radial expansion and contraction of dog 163. A person skilled in the art will understand that dog 163 may be one or more members adapted to operate as described herein. As shown, dog 163 has an interior conical cam surface 165 adapted to slidingly engage a conical cam surface 167 formed in an inwardly depending groove 169 of actuation portion 137. A person skilled in the art will recognize that conical cam surface 165 may be a portion of dog 163 as shown, or alternatively, conical cam surface 165 may extend across the entire interior portion of dog 163. In the illustrated embodiment, the angle of mating cam surfaces 165, 167 is between 5 and 15 degrees with respect to an axis 171 passing through bore 47 and stem 143. In an exemplary embodiment, the angle of mating cam surfaces 165, 167 is 10 degrees with respect to axis 171. Dog 163 may be supported by cage 151 so that dog 163 may move radially into locking groove 57 as described in more detail below. An outer periphery of dog 163 may include bevels 173 as shown. In some embodiments, such as those illustrated in FIG. 3, locking groove 57 includes a conical upper surface 81.

In operation, tree cap 123 may be run through open ocean on a wireline and brought proximate to tree head 13 by an ROV. The ROV may position tree cap 123 so that seal carrier portion 145 is positioned within bore 47 of tree head 13, actuation portion 137 is at least partially positioned within bore 47 of tree head 13, and flange 153 of cage 151 lands on an exterior surface of tree head 13. A lower end of cage 153 may rest on upward facing shoulder 149 of actuation portion 137. As shown in FIG. 8, dog 163 may be radially adjacent to locking groove 57 when flange 153 of cage 151 lands on tree head 13. While at a surface location, spreader plate 127 may be moved toward interior surface 133 of housing 125 to compress mechanical energizer 131. Mechanical locks 135 may then be inserted through openings in housing 125 to prevent movement of spreader plate 127 and mechanical energizer 131 from the compressed position. During the running operation, mechanical locks 135 maintain engagement with spreader plate 127 to prevent premature actuation of tree cap 123.

Figure 9:
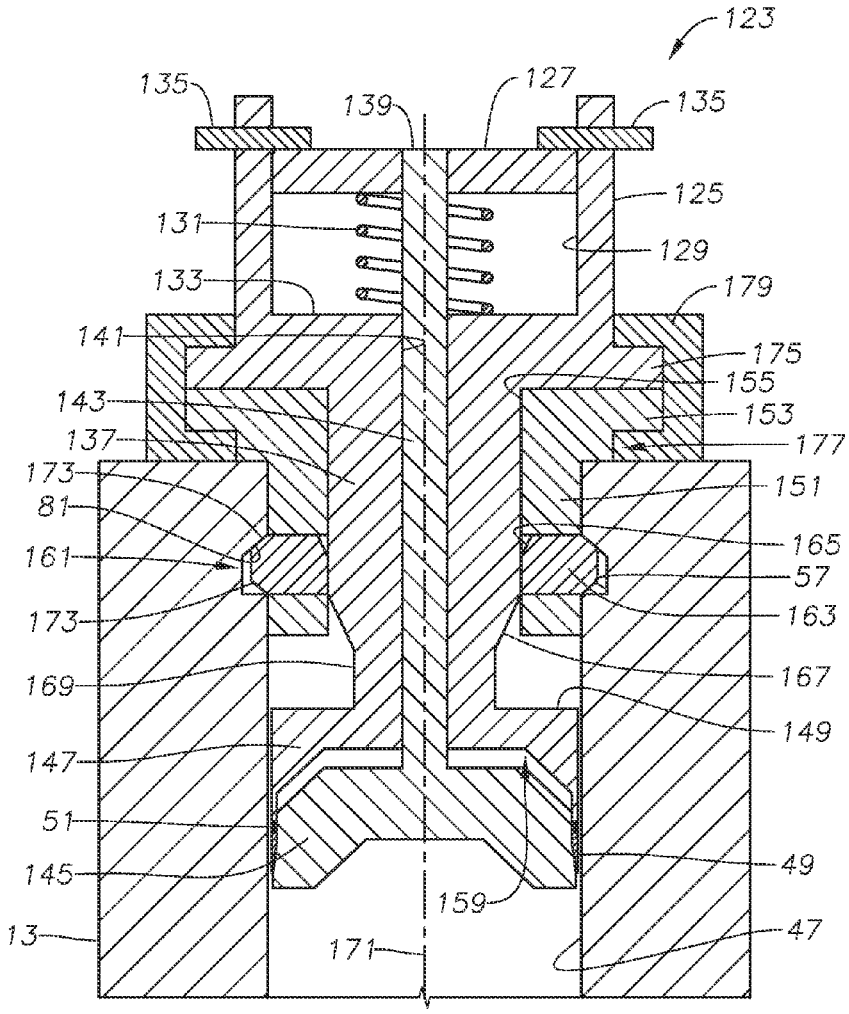
FIG. 9 is a schematic sectional view of the alternate tree cap of FIG. 8 with the tree cap locked to the subsea tree in accordance with an embodiment.

As shown in FIG. 9, tree cap 123 may be lowered further towards tree head 13, causing actuation portion 137 to move further into bore 47. Flange 153 of cage 151 lands on an upper portion of tree head 13 and prevents further movement of cage 151 into bore 47. Further movement of housing 125 toward tree head 13 causes actuation member 137 to move along axis 171 relative to cage 151. As actuation member 137 moves relative to cage 151, conical cam surface 167 of actuation portion 137 slidingly engages cam surface 165 of dog 163, driving dog 163 radially outward into locking groove 57 as cam surface 165 slides against the larger diameter portion of cam surface 167 of actuation portion 137. In this manner, tree cap 123 secures to tree head 13 to maintain tree cap 123 on tree head 13. In the illustrated embodiment, housing 125 includes an outer diameter flange 175 on a lower portion of housing 125 proximate to interior surface 133. As actuation portion 137 is lowered further into bore 47, flange 175 may contact and land on flange 153 of cage 151, preventing further movement of actuation member 137 into bore 47. As shown, flange 153 of cage 151 may include a groove 177 formed in a downward facing surface of flange 153 and on an outer diameter portion of flange 153. A mechanical coupler 179, such as the illustrated C-shaped coupler 177 may be placed around flanges 153, 175, and into groove 177, preventing separation of housing 125 and cage 151.

Figure 10:
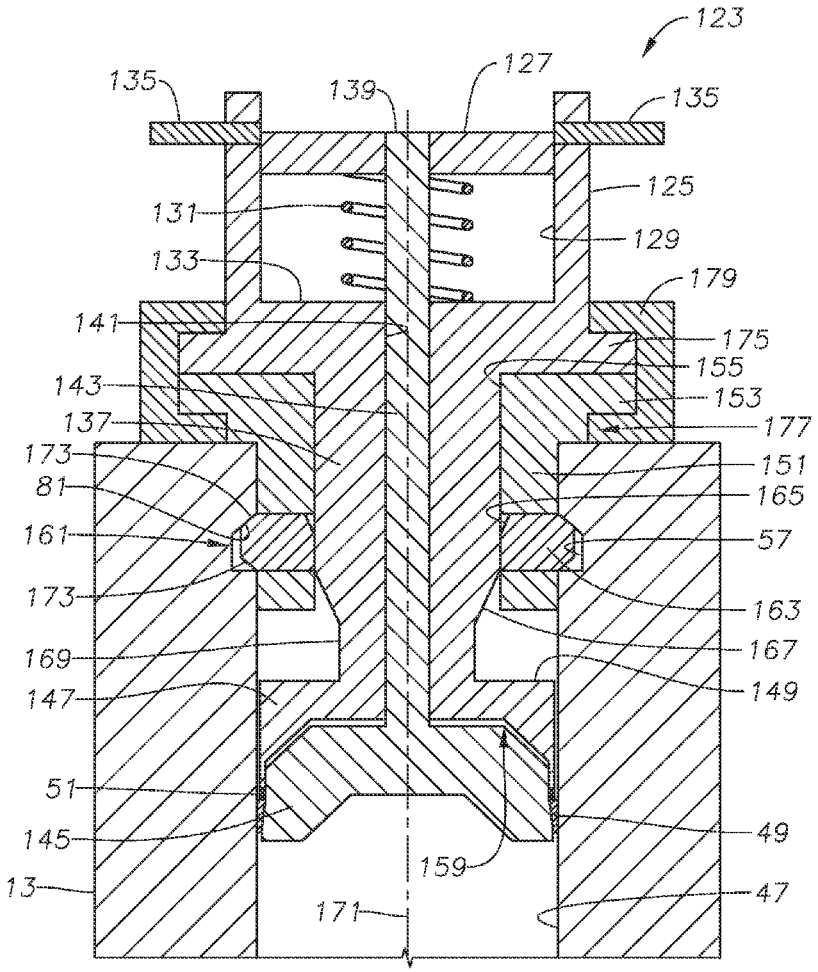
FIG. 10 is a schematic sectional view of the alternate tree cap of FIG. 8 in an energized position in accordance with an embodiment.

As shown in FIG. 10, the ROV may disengage mechanical locks 135 from spreader plate 127 by pulling each mechanical lock away from cavity 129 of housing 125, allowing the mechanical energy of mechanical energizer 131 to move spreader plate 127 away from interior surface 133 of cavity 129, pulling the mounted capping piston 139 upward from bore 47 and into engagement with lower portion 147 of actuation member 137, energizing annular seal 49 as described above with respect to FIG. 5 and sealing bore 47.

Accordingly, the disclosed embodiments provide numerous advantages. For example, the disclosed embodiments provide a subsea tree wedge seal system that can be fitted and retrieved by an ROV. The disclosed embodiments are simple to use and have a robust and reliable design. In addition, the disclosed embodiments use a metal sealing system that can function in extreme temperature, pressure, and chemical environments. Still further, the disclosed embodiments may seal to surfaces having defects or inclusions that may prevent formation of an effective seal by other sealing systems. Moreover, the disclosed embodiments are easily adaptable to any suitable tree bore diameter.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A tree cap assembly for capping a bore of a subsea wellhead assembly, the bore having an axis, the tree cap assembly comprising:

an annular cage member selectively insertable into the bore formed in the wellhead assembly, the annular cage member comprising, sidewalls that define an interior, and a flange that projects radially outward from a terminal end of the sidewalls and selectively land on an upper end of the wellhead assembly;

a cam element having a portion positioned in the interior of the cage member and that has a conically shaped outer periphery, the cam element being axially movable with respect to the cage member and the conically shaped outer periphery being in selective contact with the cage member;

an annular actuation member on a terminal end of the cage member and which circumscribes a portion of the cam element;

an annular seal between the cam element and an inner surface of the bore, the cam element selectively energizing the annular seal by compressing the annular seal axially with the actuation member to form a pressure barrier in the bore;

a locking assembly comprising a dog that projects radially outward through a sidewall of the cage member into selective engagement with a groove that circumscribes the bore; and an actuation assembly coupled to the cam element so that when actuated, the actuation assembly moves the cam element axially relative to the annular cage member to compress the seal against the actuation member.

2. The tree cap assembly of claim 1, wherein the annular seal is formed of a material selected from the group consisting of lead, tin, silver, gold, and alloys thereof.

3. The tree cap assembly of claim 1, wherein the cam element receives pressure on a lower surface and from the bore to further compress the seal.

4. The tree cap assembly of claim 1, wherein the cam element comprises:

a stem extending from the bore to the actuation assembly through the interior of the cage member;

a medial portion mounted to the stem and having a conical surface that selectively engages the dog to drive the dog into the groove; and a seal carrier portion mounted to the medial portion opposite the stem and configured to carry the annular seal and energize the annular seal in response to axial movement of the cam element.

5. The tree cap assembly of claim 1, the actuation assembly comprising:

a housing having a cavity; and an axially moveable spreader plate positioned in the cavity, the spreader plate having a width substantially equivalent to a width of the cavity, the cam element coupled to the spreader plate so that axial movement of the spreader plate moves the cam element to compress the annular seal against the actuation member.

6. The tree cap assembly of claim 5, wherein the actuation member depends from a lower end of the cage member.

7. The tree cap assembly of claim 5, the actuation assembly further comprising a mechanical energizer extending from a wall of the housing disposed proximate to a subsea tree when the tree cap lands on a tree head of the subsea tree to the spreader plate, the mechanical energizer configured to exert an axial force on the spreader plate to drive the spreader plate axially upward.

8. The tree cap assembly of claim 7, wherein the mechanical energizer is further configured to maintain an axial force on the spreader plate to maintain the annular seal in the energized position.

9. The tree cap assembly of claim 7, the actuation assembly further comprising a hydraulic actuator positioned opposite the mechanical energizer to move the spreader plate axially to compress the mechanical energizer to maintain the seal in the unset position during running and retrieval of the tree cap assembly.

10. The tree cap assembly of claim 1, wherein the actuation assembly comprises:

a housing having a cavity and configured to receive and direct hydraulic pressure;

a hydraulic piston having an actuation surface and a retrieval surface, the hydraulic piston positioned in a cavity of the housing and configured to move axially in response to application of hydraulic fluid pressure to the actuation and retrieval surfaces;

the cam element coupled to the hydraulic piston so that axial movement of the hydraulic piston moves the cam element to compress the annular seal against the actuation member; and one or more valves actuable to selectively permit application of hydraulic fluid pressure to the actuation and retrieval surfaces of the hydraulic piston.

11. The tree cap assembly of claim 10, wherein the actuation assembly further comprises:

an accumulator to store at least one of hydraulic fluid pressure and gas pressure;

a charge valve in communication with the accumulator to selectively supply at least one of hydraulic fluid pressure and gas pressure to the accumulator and vent at least one of hydraulic fluid pressure and gas pressure from the accumulator;

an accumulator valve positioned between the accumulator and the actuation assembly and in communication with the actuation surface of the hydraulic piston to selectively allow communication between the accumulator and the actuation surface of the hydraulic piston;

wherein the accumulator, the charge valve, and the accumulator valve are configured to selectively apply at least one of hydraulic fluid pressure and gas pressure to the actuation surface of the hydraulic piston; and wherein the application of at least one of hydraulic fluid pressure and gas pressure from the accumulator maintains the energization of the seal.

12. A tree cap assembly for capping a bore of a subsea wellhead assembly, the bore having an axis, the tree cap assembly comprising:

an annular cage member selectively insertable into the bore formed in the wellhead assembly, the annular cage having an interior;

an annular actuation member depending from a lower end of the cage member;

a cam element having a portion positioned in the interior of the cage member and axially movable with respect to the cage member;

an annular seal between the cam element and an inner surface of the bore, the cam element selectively energizing the annular seal by compressing the annular seal axially against the actuation member to form a pressure barrier in the bore;

a locking assembly comprising a dog that projects radially outward through a sidewall of the cage member into selective engagement with a groove that circumscribes the bore;

a housing having a cavity and configured to receive and direct hydraulic pressure;

a hydraulic piston having an actuation surface and a retrieval surface, the hydraulic piston positioned in a cavity of the housing and configured to move axially in response to application of hydraulic fluid pressure to the actuation and retrieval surfaces;

the cam element coupled to the hydraulic piston so that axial movement of the hydraulic piston moves the cam element to compress the annular seal against the actuation member by moving the cam element axially relative to the annular cage member;

one or more valves actuable to selectively permit application of hydraulic fluid pressure to the actuation and retrieval surfaces of the hydraulic piston.

an accumulator to store at least one of hydraulic fluid pressure and gas pressure;

a charge valve in communication with the accumulator to selectively supply at least one of hydraulic fluid pressure and gas pressure to the accumulator and vent at least one of hydraulic fluid pressure and gas pressure from the accumulator;

an accumulator valve positioned between the accumulator and the actuation assembly and in communication with the actuation surface of the hydraulic piston to selectively allow communication between the accumulator and the actuation surface of the hydraulic piston;

wherein the accumulator, the charge valve, and the accumulator valve are configured to selectively apply at least one of hydraulic fluid pressure and gas pressure to the actuation surface of the hydraulic piston; and wherein the application of at least one of hydraulic fluid pressure and gas pressure from the accumulator maintains the energization of the seal.

13. The tree cap assembly of claim 12, wherein the annular seal is formed of a material selected from the group consisting of lead, tin, silver, gold, and alloys thereof.

14. The tree cap assembly of claim 12, wherein the cam element receives pressure on a lower surface and from the bore to further compress the seal.

15. The tree cap assembly of claim 12, wherein the cam element comprises:

a stem extending from the bore to the actuation assembly through the interior of the cage member;

a medial portion mounted to the stem and having a conical surface that selectively engages the dog to drive the dog into the groove; and a seal carrier portion mounted to the medial portion opposite the stem and configured to carry the annular seal and energize the annular seal in response to axial movement of the cam element.

16. The tree cap assembly of claim 12, wherein the annular seal comprises a wedge-type cross sectional profile.

17. A method for capping and sealing a subsea tree including a tree head, a bore having an axis, and a locking groove formed therein, the method comprising:

(a) providing a subsea tree cap having a cam element carrying an annular metal seal having a wedge type profile, the cam element moveable along the axis of the bore;

(b) running the subsea tree cap to the subsea tree located proximate to the sea floor;

(c) positioning a portion of the cam element in the bore and lowering the subsea tree cap to land on the subsea tree;

(d) moving the cam element axially upward to secure the subsea tree cap to the subsea tree and deformingly engage the annular metal seal to seal to the subsea tree cap and the bore of the subsea tree; and (e) slidingly engaging a medial portion of the cam element having a conical profile against a conical cam surface of an annular dog carried by the subsea tree cap to expand the annular dog radially into the locking groove of the bore.

18. The method of claim 17, wherein step (d) further comprises compressing the annular metal seal between a lower conical portion of the cam element and an actuation member depending from an outer diameter of a cage of the tree cap positioned in the bore of the subsea tree.

19. The method of claim 17, wherein step (d) further comprises removing hydraulic pressure from a hydraulic cylinder exerting a downward axial force on the cam element, thereby allowing a mechanical energizer coupled to the cam element to exert an upward axial force on the cam element.

20. The method of claim 17, wherein step (d) further comprises supplying hydraulic fluid pressure to a hydraulic piston coupled to the cam element to move the cam element axially upward and releasing gas pressure stored in an accumulator of the subsea tree cap to exert an upward axial force on the cam element that maintains the engagement of the seal to the bore.

21. The method of claim 17, further comprising maintaining an upward axial force on the hydraulic piston to accommodate for thermal expansion and contraction of the subsea tree and creep and stress relaxation of the annular seal.

* * * * *